United States Patent [19]

Meier

[11] Patent Number: 4,565,239

[45] Date of Patent: Jan. 21, 1986

[54] APPARATUS FOR SCREENING A STREAM OF MOLTEN METAL

[75] Inventor: Ernst Meier, Wollerau, Switzerland

[73] Assignee: F.H.I. Finanz-, Handels und Investment AG, Zug, Switzerland

[21] Appl. No.: 639,372

[22] Filed: Aug. 8, 1984

[30] Foreign Application Priority Data

Aug. 12, 1983 [CH] Switzerland ..... 4415/83

[51] Int. Cl.[4] ..... B22D 11/00

[52] U.S. Cl. ..... 164/475; 164/415

[58] Field of Search ..... 164/475, 415, 259

[56] References Cited

U.S. PATENT DOCUMENTS

| | | | |
|---|---|---|---|
| 2,889,596 | 6/1959 | Savage et al. | 164/415 X |
| 4,102,386 | 7/1978 | Hildebrant et al. | 164/475 X |
| 4,200,138 | 4/1980 | Hilderbrant | 164/475 |

FOREIGN PATENT DOCUMENTS

| | | | |
|---|---|---|---|
| 0081303 | 6/1983 | European Pat. Off. | 164/475 |
| 2028196A | 3/1980 | United Kingdom | 164/475 |

*Primary Examiner*—Nicholas P. Godici
*Assistant Examiner*—K. F. Berg
*Attorney, Agent, or Firm*—Benoit Law Corporation

[57] ABSTRACT

An apparatus for screening a stream of molten metal has a bellows. An annular distribution chamber for protective gas to be blown into an area traversed by the stream of molten metal is provided inside the bellows. That annular chamber is inwardly delimited by a flexible screening shroud of heat-resistant, gas-permeable material encompassing the area traversed by the stream of molten metal and being inwardly spaced from the bellows. Corresponding ends of the bellows and shroud are gas-tightly interconnected. The screening shroud surrounding the pouring stream at a distance protects the bellows from metal splashes and screen it also from heat that is radiating from the pouring stream.

24 Claims, 1 Drawing Figure

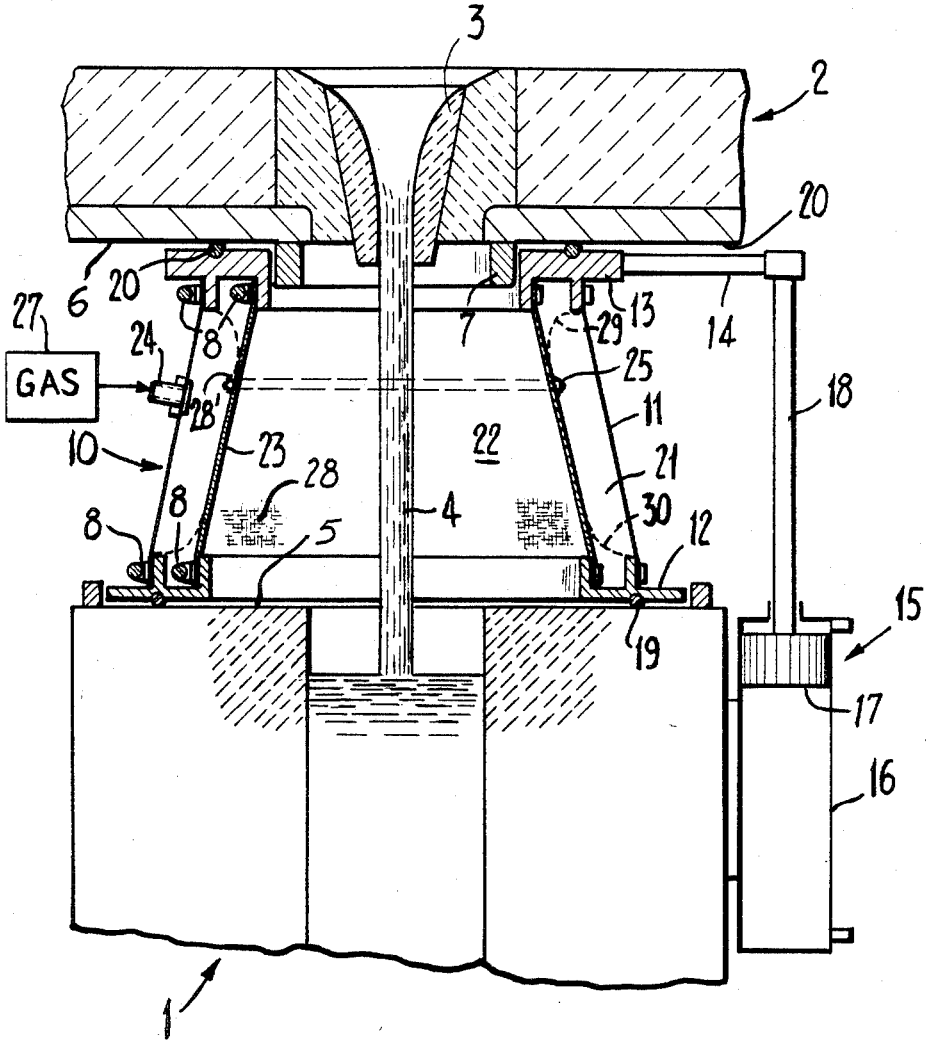
3
2
20
6
20
27
GAS
24
8
28'
10
23
28
8
8
5
4
7
29
13
14
25
11
22
21
30
12
18
15
19
17
16
1

APPARATUS FOR SCREENING A STREAM OF MOLTEN METAL

BACKGROUND OF THE INVENTION

1. Field of the Invention

The subject invention relates to metal casting and pouring technology and, more specifically, to screening a stream of molten metal.

2. Information Disclosure Statement

A screening apparatus for molten metal is known from German Patent No. DE 28 34 746, which discloses bellows provided with ring flanges on both sides for connection on one side to the bottom of a pouring vessel and on the other side to the upper side of a casting mold.

In order to render the pouring spout, and if necessary the casting interval space, accessible, the lower ring flange can be lifted rapidly to the upper ring flange by folding the bellows by means of a lifting device.

A protective gas is introduced into the area surrounding the pouring stream via a gas distribution ring that is connected to a supply line leading to the outside. However, maintenance of a protective gaseous atmosphere in the area surrounding the pouring stream is often impeded by the fact that the bellows starts to leak relatively quickly. If this leakage occurs during the casting process, an attempt to prevent the entrance of air to the pouring stream must be made by means of an increased supply of protective gas in an effort to avoid reoxidation. Otherwise the pouring process must be interupted, which is very undesirable. In addition to the expenses for large amounts of protective gas, the corresponding frequent replacement of bellows adds to operating expenses.

The above mentioned German Patent No. DE 28 34 746 also cites many patent references in turn.

SUMMARY OF THE INVENTION

It is a general object of this invention to overcome the disadvantages and to meet the needs expressed or implicit in the above Information Disclosure Statement or in other parts hereof.

It is a germane object of this invention to create a screening system and apparatus providing improved heat protection for the operating personnel and increased service life in metal casting and similar systems.

Other objects of this invention will become apparent in the further course of this disclosure.

From one aspect thereof, the subject invention resides in apparatus for screening a stream of molten metal, comprising, in combination, a bellows, means for retaining splashes and heat radiating from the stream of molten metal and for providing inside that bellows an annular distribution chamber for protective gas to be blown into an area traversed by the stream of molten metal, including a flexible screening shroud of heat-resistant, gas-permeable material encompassing the area traversed by the stream of molten metal and being inwardly spaced from the bellows, and means for gas-tightly interconnecting corresponding ends of the bellows and the shroud.

Other aspects of the invention will become apparent in the further course of this disclosure.

BRIEF DESCRIPTION OF THE DRAWINGS

The subject invention and its various aspects and objects will become more readily apparent from the following detailed description of preferred embodiments thereof, illustrated by way of example in the accompanying drawing which is a vertical section of a part of a continuous casting apparatus.

DESCRIPTION OF PREFERRED EMBODIMENTS

The continuous casting plant of which part is shown in the accompanying drawing may, for instance, be used for casting a metal, such as steel, and includes a mold 1 and a molten metal distribution vessel 2. The distribution vessel 2 has a bottom outlet 3 for releasing a metal pouring stream 4 into the mold 1. In order to prevent the admission of air to the pouring stream 4 and the molten material in the mold 1 and in order to decrease the stress of operating personnel, particularly from the immediate proximity of radiating heat from the pouring stream, a screening apparatus, generally designated 10, extends between a jacket 6 of the distribution vessel 2 and the upper side 5 of the mold 1.

The screening device 10 includes a bellows 11 which is circular in cross-section and coaxially surrounds the pouring stream 4. The bellows 11, consisting of a material that is impermeable to gasses, receives its cross-sectional shape from its clamping by means of expansion rings 8 between two ring flanges 12 and 13. The ring flange 12 may be held at the upper side 5 of the mold by dowel pins, chucking wedges or other fastening means (not shown). At the other end, the ring flange 13 is fastened to the arm 14 of a lifting device including a cylinder-piston unit 15.

In the illustrated arrangement, the cylinder 16 of the unit 15, by way of example is rigidly fastened to the mold 1, whereas the piston rod 18 which is connected to the piston 17 supports the arm 14. Via the arm 14 the unit presses the ring flange 13 onto the jacket 6 of the distribution vessel 2. In order to achieve a gas-proof connection of the bellows to the mold, and to the distribution vessel, sealing rings 19 and 20 are provided between the ring flanges 12 and 13 and the upper side 5 and the jacket 6, respectively. Within the ring flange 13 a centering ring 7 is provided on the jacket 6.

According to the subjects invention, the screening apparatus 10 is provided inside bellows 11 with a annular gas distribution chamber 21 for protective gas from a supply 27, to be blown into an area 22 traversed by the stream of molten metal 4. The means for providing the annular chamber 21 include a flexible screening skirt or shroud 23 of heat-resistant, gas-permeable material encompassing the area 22 which is traversed by the pouring stream 4 and being inwardly spaced from the bellows 11. The annular chamber 21 is delineated from the pouring area 22 by the screening shroud 23. The outer boundary of the annular chamber 21 is defined by bellows 11.

An intake nozzle 24, connected to a source of protective gas 27, is installed on bellows 11 and leads into the gas distribution chamber 21 for supplying protective gas thereto.

In contrast to the gas-tight material of the bellows 11, the shroud 23 is made from a material that is both permeable to gasses and heat or fire proof. This may be a textile material 28, such as a webbing of silicon dioxide filaments, or other material that will not be affected by splashing molten metal. Similarly to the bellows 11, whose material can be plasticized webbing, such as a silicon covered glass fibre webbing, the screening shroud 23 is also flexible. Its ends are also fastened to ring flanges 12 and 13, respectively, by tensioning rings 8. These may be of smaller diameter than the rings 8 with which the corresponding ends of the bellows 11 are attached to the flanges 12 and 13.

The bellows 11 and the shroud 23 are in the shape of conical frustrums, which preferably have equal cone angles, and which are arranged uprightly and have different base diameters. As seen in the drawing, the ring flanges 12 and 13, coupled to the bellows 11 and shroud 23, arrange the bellows and shroud in unfolded condition about the stream of molten metal 4. In the illustrated preferred embodiment of the invention, the unfolded bellows 11 and shroud 23 and the flanges 12 and 13 for interconnecting corresponding ends of those bellows and shroud, envelop the stream of molten metal 4 from the outlet 3 down to the mold 1.

A stiffening ring 25 is connected to the shroud 23 at an outside, and spaced from the ends of the shroud. The ring 23 preferably is arranged horizontally somewhat above midlevel and connected over the entire circumference by suitable means, such as loops 28' provided on the shroud.

If the upper ring flange 13 is lowered by deactivating the unit 15, whereby the bellows 11 and the shroud 23 are folding themselves, the stiffening ring 25 limits the folding width and prevents that parts of the folds could reach the proximity of the path of the pouring stream 4. When in lowered position, the conic frustum shape of the bellows and the shrouds allows a distribution of the folds over a larger area of the diameter and they thus are under diminished stress when in telescoped position.

When operating the screening apparatus 10, positive pressure is established in the chamber 22 that suffices to positively prevent the intrusion of air to the molten material. Pressure losses in the chamber 22 are being equalized by the fact that protective gas will flow from the gas distribution chamber 21 through the screening shroud 23 that is permeable to gasses. Hereby the gas distribution chamber 21 is consistently supplied with protective gas by means of the nozzle 24. In the gas distribution chamber, a gas cushion with a higher pressure than the pressure in chamber 22 is formed.

In addition to the fact that the shroud 23 presents a protective screening to the bellows 11 with respect to the pouring stream and by retaining splashes and radiating heat, the shroud 23 has also an insulating effect relative to the temperatures present in chamber 22, despite its porosity. This is mainly the case because gasses from the gas cushion are flowing through the shroud from its outside to it inside. The direction of flow of the protective gas is thereby opposed to the gradient of temperature, whereby the temperature prevalent in the gas cushion, because of its constant renewal is substantially below the temperature in the area 22. Therefore, heat tends to be extracted at the shroud 23 during its permeation by gas and distribution of gas at the inside thereof.

Instead of fastening the corresponding ends of the bellows 11, and the shroud 23 separately and to different diameters onto ring flanges 12 and 13, these ends can, after mutual adaptation of the diameters, jointly be fastened by means of a single tensioning ring at each end. As shown by dotted lines at 29 and 30 in the drawing, corresponding ends of the bellows 11 and the shroud 23 may be equal in diameter. As also indicated by these dotted lines 29 and 30, the bellows 11 and the shroud 23 may be directly joined to each other at their corresponding ends, respectively. Similarly, it is also possible to directly join the ends of bellows and shroud in order to form a unit independent of the ring flanges 12 and 13, for the purpose of transportation and storage or in order to facilitate installation thereof on the ring flanges. In any case, due to the prevalent positive pressure, a gas cushion forms between the bellows and the shroud during operation, keeping the shroud 23 at a distance from the bellows 11, as shown in the drawing, or keeping the bellows at a distance from the shroud, with the exception of their ends. By means of the type of direct interconnection shown by dotted lines 29 and 30, the bellows and shroud may be assembled into an integral unit. Suitable assembly means thereby include the flanges 12 and 13 or other annular devices, such as an annulus at each set of corresponding ends of bellows 11 and shroud 23.

The screening device preferably is adjusted in its cross-section and particularly with respect to the profile of its cross-section to the format to be cast or to the size and form of the vessel opening into which the metal stream is poured. When casting slab ingots it is, for instance, useful to install the screeining device in form of a pyramidic frustum with corresponding proportion of sides.

The subject invention takes account of the fact that the service life of an airtight bellows does not only depend on the mechanical wear and tear and the stress from radiating heat, but also that splashes leading to damage can occur even during normal casting procedures.

With respect to the protection of the bellows 11, the screening shroud 23 fulfills several functions by catching splashes blocking heat radiation produced by the pouring stream defining a thermically isolating gas padding 21 and, finally, rendering an exchange of gas in the gas cushion possible, such as by axial and circumferentially distributed discharge of protective gas into the area 22 surrounding the pouring stream or jet 4.

By freeing the bellows 11 according to the invention from the tasks of providing protection from splashes and heat radiation and by transferring these tasks to the screening shroud 23, the heat stress of the bellows is hereby essentially diminished and its impermeability with respect to gases remains permanently conserved.

The heat stress of the bellows is further decreased by the gas cushion present in the gas distribution chamber 21. Hereby it is important that the gas is in motion, thus discharging absorbed heat into the area surrounding the pouring stream and being replaced by fresh and cooler gas.

Furthermore, the penetration of gas as distributed via the screening shroud 23 guarantees a distributed dispersion to the hot side of the screening shroud. This fact prevents individual surface areas on the hot side from reaching temperatures that would cause accelerated aging. Even though the gas reaches substantial temperatures when streaming through the distribution chamber, it is still capable, when passing through or leaving the screening shroud, of having a cooling effect, thus diminishing the long term heat stress.

The gas cushion in the gas distributing chamber 21 finally has the effect of keeping the screening shroud 23 and the bellows 11 radically apart from each other, to the extent as they are able to move independently of each other. A telescoping movement of the bellows 11 is not obstructed by the screening shroud 23 since, due to its flexibility, it is also readily foldable.

The prior-art stiffening rings, formerly provided for effecting a regular folding of bellows during the telescoping process, are no longer needed in the practice of the subject invention.

However, it is useful to provide one or more stiffening rings 25 for the screening shroud 23 where the axial extension of the shroud is greater than one in its proportional relationship to the diameter. In this manner, the occurrence of folds which could come dangerously near the pouring stream 4 during the telescoping or screen apparatus collapsing process is prevented.

Due to the invention it is possible to make use of relatively small upper diameters in the fustonical or other tapered shapes of the bellows 11 and shroud 23, without incurring any danger that the screening apparatus would be damaged by proximity to the pouring stream.

The ends of the bellows 11 and the screening shroud 23 can individually be fastened detachably to each an upper or lower joint ring flange 12 and 13 made of metal and connected to each other via each of these rings. If desired, the nozzle 24 and a bore leading to the annular chamber 21 may be provided on or in one of the flanges 12 and 13 for applying protective gas thereto. This construction permits the bellows 11 and the screening shroud 23 to be exchanged individually.

However, since an exchange is much less frequently necessary, since both parts 11 and 23 now have somewhat similar service lives, the bellows 11 and the shroud 23 may not only be joined to one ring flange, but bellows 11 and shroud 23 may be directly joined to each other at their corresponding ends, as indicated by dotted lines 29 and 30 in the drawing. In this case the nozzle 24 can be directly positioned in the bellows.

In order to decrease the heat stress on the bellows 11 further, particularly under extreme conditions, several options are available within the scope of the subject invention.

For instance, the shroud 23 can be made in the form of a several layered formation, or an additional intermediate screen—made of the same material as the screening shroud 23 and equally permeable to gasses—can define an outer gas distribution chamber which surrounds the chamber 21 adjacent to the shroud 23 thus spacing and thermically insulating the bellows 11 with regard to the shroud 23. The introduction of the fresh gas thus takes place in the outer chamber from which it is distributed equally through the intermediate screen into the inner chamber 21. This results in a gas cushion in the outer chamber which, as a whole, is of a temperature that is substantially lower than the temperature of the cushion immediately adjacent to the shroud 23.

Futhermore or alternatively it is also possible to intensify the protective gas exchange in the gas cushion or cushions by drawing off the heated gas and by reintroducing it after cooling.

The subject invention resides also in a method of screening a stream of molten metal with the aid of a bellows 11. This method according to the invention provides inside bellows 11 an annular distribution chamber 21 for protective gas to be blown into an area traversed by the stream of molten metal 4, and inwardly delimits that annular chamber 21 by a flexible screening shroud 23 of heat-resistant, gas-permeable material encompassing the area 22 traversed by the stream of molten metal and being inwardly spaced from the bellows 11. Corresponding ends of the bellows 11 and shroud 23 are gas-tightly interconnected.

According to the illustrated preferred embodiment, the bellows 11 and shroud 23 are made to increase in cross-section in the direction of flow of the stream metal 4, such as for the reasons disclosed in the above description of the accompanying drawing. As indicated above, all parts of the flexible screening shroud 23 may at all times be maintained in spaced relationship to the stream of molten metal by attaching at least one stiffening ring 25 to the shroud 23 at a distance from the ends thereof.

Various alternatives, modifications and variations which the spirit and scope of the subject invention and equivalents thereof will become apparent from the subject extensive disclosure or suggest themselves to those skilled in the art.

I claim:

1. Apparatus for screening a stream of molten metal, comprising in combination:

a bellows;

means for retaining splashes and heat radiating from said stream of molten metal and for providing inside said bellows an annular distribution chamber for protective gas to be blown into an area traversed by the stream of molten metal, including a flexible screening shroud of heat-resistant, gas-permeable material encompassing said area traversed by the stream of molten metal and being inwardly spaced from said bellows; and means for gas-tightly interconnecting corresponding ends of said bellows and shroud.

2. Apparatus as claimed in claim 1, wherein an outer boundary of said annular distribution chamber is defined by the bellows.

3. Apparatus as claimed in claim 1, including a nozzle on the bellows for supplying protective gas to said annular distribution chamber.

4. Apparatus as claimed in claim 2, including a nozzle on the bellows for supplying protective gas to said annular distribution chamber.

5. Apparatus as claimed in claim 2, wherein said bellows and said shroud define a profile increasing in cross section in the direction of flow of said stream of molten metal.

6. Apparatus as claimed in claim 5, wherein said bellows and said shroud are in the shape of conical frustums.

7. Apparatus as claimed in claim 6, wherein said conical frustums have equal cone angles.

8. Apparatus as claimed in claim 1, including:

a stiffening ring connected to said shroud at an outside, and spaced from ends, of said shroud.

9. Apparatus as claimed in claim 8, wherein corresponding ends of said bellows and said shroud are equal in diameter.

10. Apparatus as claimed in claim 9, wherein said bellows and said shroud are directly joined to each other at their corresponding ends.

11. Apparatus as claimed in claim 8, wherein said means for gas-tightly interconnecting said bellows and said shroud include means for assembling said bellows and said shroud into an integral unit.

12. Apparatus as claimed in claim 11, wherein said assembling means include an annulus at each set of corresponding ends of said bellows and said shroud.

13. Apparatus as claimed in claim 12, wherein each annulus is a ring flange.

14. Apparatus as claimed in claim 1, wherein corresponding ends of said bellows and said shroud are equal in diameter.

15. Apparatus as claimed in claim 14, wherein said bellows and said shroud are directly joined to each other at their corresponding ends.

16. Apparatus as claimed in claim 14, wherein said means for gas-tightly interconnecting said bellows and said shroud include means for assembling said bellows and said shroud into an integral unit.

17. Apparatus as claimed in claim 16, wherein said assembling means include an annulus at each set of corresponding ends of said bellows and said shroud.

18. Apparatus as claimed in claim 17, wherein each annulus is a ring flange.

19. A method of screening a stream of molten metal with the aid of a bellows, comprising in combination the steps of:

providing inside said bellows an annular distribution chamber for protective gas to be blown into an area traversed by the stream of molten metal;

retaining splashes and heat radiating from said stream of molten metal and for inwardly delimiting said annular chamber with a flexible screening shroud of heat-resistant gas-permeable material encompassing said area traversed by the stream of molten metal and being inwardly spaced from said bellows; and gas-tightly interconnecting corresponding ends of said bellows and shroud.

20. A method as claimed in claim 19, wherein said bellows and said shroud are made to increase in cross-section in the direction of flow of said stream of molten metal.

21. Apparatus for screening a stream of molten metal, comprising in combination:

a gas impermeable bellows of flexible material;

means for retaining splashes and heat radiating from said stream of molten metal and for conserving gas impermeability of said bellows, including an annular gas-permeable and heat-resistant screening shroud of flexible material, arranged within and foldable with said bellows;

means for gas-tightly interconnecting corresponding ends of said bellows and shroud;

an annular gas distribution chamber enclosed between said bellows and said shroud;

means for supplying protective gas to said annular gas distribution chamber to create a flow of gas from said distribution chamber to the interior of said shroud through said shroud; and means coupled to said bellows and shroud for arranging said bellows and shroud in unfolded condition about said stream of molten metal.

22. Apparatus as claimed in claim 21, wherein:

said stream of molten metal extends from an outlet to a mold; and said unfolded bellows and shroud and said means for interconnecting corresponding ends of said bellows and shroud envelop said stream of molten metal from said outlet to said mold.

23. Apparatus for screening a stream of molten metal, comprising in combination:

a gas impermeable bellows of flexible material;

means for retaining splashes and heat radiating from said stream of molten metal and for conserving gas impermeability of said bellows, including an annular gas-permeable and heat-resistant screening shroud of flexible material, arranged within and foldable with said bellows;

means for gas-tightly interconnecting corresponding ends of said bellows and shroud;

an annular gas distribution chamber enclosed between said bellows and said shroud;

means including a nozzle on said bellows for supplying protective gas to said annular gas distribution chamber to create a flow of gas from said distribution chamber to the interior of said shroud through said shroud; and means coupled to said bellows and shroud for arranging said bellows and shroud in unfolded condition about said stream of molten metal in a profile increasing in cross section in the direction of flow of said stream of molten metal.

24. Apparatus as claimed in claim 21, wherein:

said stream of molten metal extends from an outlet to a mold; and said unfolded bellows and shroud and said means for interconnecting corresponding ends of said bellows and shroud envelop said stream of molten metal from said outlet to said mold.

* * * * *